US005921382A

United States Patent [19]

Retter

[11] Patent Number: 5,921,382

[45] Date of Patent: Jul. 13, 1999

[54] MAGNETICALLY ENHANCED MEMBRANE SWITCH

[75] Inventor: Dale Retter, Scottsdale, Ariz.

[73] Assignee: DataHand Systems, Inc, Phoenix, Ariz.

[21] Appl. No.: 09/164,146

[22] Filed: Sep. 30, 1998

Related U.S. Application Data

[51] Int. Cl.[6] ..... H01H 13/70

[52] U.S. Cl. ..... 200/514; 200/5 A; 335/205

[58] Field of Search ..... 200/5 R, 5 A, 200/600, 511–517, 520, 341; 335/78–86, 124, 177–179, 185, 194, 202, 206, 207, 234, 205; 400/472–474, 477, 479, 479.2, 490, 496

[56] References Cited

U.S. PATENT DOCUMENTS

| | | | |
|---|---|---|---|
| 3,383,487 | 5/1968 | Wiener | 200/168 |
| 3,681,723 | 8/1972 | Goll | 335/207 |
| 4,211,991 | 7/1980 | Lombard | 335/207 |
| 4,349,712 | 9/1982 | Michalski | 200/159 B |
| 4,564,832 | 1/1986 | Inoue | 340/365 R |
| 4,882,581 | 11/1989 | Inobe et al. | 341/22 |
| 4,977,298 | 12/1990 | Fujiyama | 200/5 A |
| 5,475,353 | 12/1995 | Roshen et al. | 335/78 |
| 5,523,730 | 6/1996 | Van Zeeland | 335/205 |
| 5,742,012 | 4/1998 | Franzke et al. | 200/5 A |

*Primary Examiner*—Michael A. Friedhofer
*Attorney, Agent, or Firm*—LaValle D. Ptak

[57] ABSTRACT

A magnetically enhanced membrane switch operator is constructed with a rigid ferromagnetic base plate. This base plate is spaced from a rigid ferromagnetic cover plate, which has an opening through it. A resilient flexible membrane sheet is suspended between the base plate and the cover plate, and is located in close proximity to the cover plate. The sheet carries a circular magnetic disk which, in the rest condition operation of the switch operator, is adhered by magnetic attraction to the cover plate. To operate the switch, sufficient force to overcome the magnetic attraction between the magnet and the cover plate, along with the force required to distort the resilient membrane sheet, is used to move the sheet toward the base plate. When the membrane sheet is moved into close proximity to the base plate, magnetic attraction between the base plate and the magnet facilitates closure of the switch at the end of its travel. The force of attraction between the magnet and the base plate is less than the resilient return force of the flexible membrane; so that when pressure on the membrane through the opening in the cover plate is removed, the return force of the membrane causes the magnet and the resilient flexible membrane sheet to be returned to the original standby position where the magnet is attracted to the rigid cover plate.

23 Claims, 1 Drawing Sheet

16
10
11
14
12
2
2
18
10
26
28
24
12
30
11
22
10
28
20
18
18
20
10
22
12
24
30
11
26
28

MAGNETICALLY ENHANCED MEMBRANE SWITCH

BACKGROUND

Membrane switches enjoy widespread use because they are inexpensive to manufacture, are easily custom configured, and are fairly reliable. Such uses include computer keyboards and electronic devices of almost every description. Common examples include such diverse products as video cameras, washing machines, hand held calculators and scientific and medical equipment. Even though membrane switches are in widespread use, two important inherent weaknesses are present in these switches.

A first weakness of membrane switches is that they have poor tactile feedback as provided to a human switch operator. One aspect of this poor tactile feedback relates to the initial travel of the switch. At the onset of switch motion, there is no distinctive tactile indication that the switch is starting to move. A tactile indication that a switch surface is just starting to move, but has definitely not begun to move far enough to reach its point of activation, is sometimes referred to as "tease". Membrane switch technology inherently has no, or very little, tease. Tease is considered desirable in many circumstances. For example, the shutter button on a camera requires or benefits from a tactile warning before its activation. This application is one in which the lack of tease of a membrane switch makes such a switch unsuitable; and other switch technologies generally are used. Even though membrane switches normally are not used to activate the shutter button on a camera, such membrane switches are used in less expensive and smaller or more easily configured switches to control less critical features on the camera. Mechanical switches, however, provide a tactile indication for the shutter activation that the switch is starting to move, and typically, a second indication that the switch is near its point of activation. This is not possible with conventional membrane switches.

A second lack of tactile feedback inherent in membrane switches is the poor ability of the operator to tactilely determine that the switch has been activated. Membrane switches which are used with a computer keyboard frequently employ a collapsible cylindrical collar made of silicone rubber to produce a breakaway sensation and a verification of activation, which is not otherwise provided by the membrane switch.

Another lack of tactile feedback of membrane switches relates to the ability of the operator to reduce the force necessary to hold the switch in its activated position, and thereby receive a warning that the operating key surface is starting to move toward the inactive position. To be most useful, this tactile warning sensation must be provided before the switch becomes inactive; so that an operator may calibrate the pressure applied to the switch by decreasing the pressure to the point where the tactile warning signal is felt. Once this warning is felt, the operator then may slightly increase the pressure just enough to move past this warning pressure zone. This is important because it allows a switch operator to calibrate the activation foreseen; so that excessive force is not required to guarantee that the switch is not inadvertently released.

A second primary inherent weakness in membrane switch technology is that membrane switches have little or no hysteresis. Consequently, these switches are known to undergo what is known as "chatter". Chatter is a situation in which the switch oscillates between its activated "on"position and its inactivated or "off" position. Hysteresis, as frequently used with switches, is a situation in which the "on" and the "off" positions are physically different positions. For example, a switch with hysteresis might, on its downward travel, need to be depressed three-fourths of its possible total travel in order to enter its "on" position. Such a switch, however, may not return to its "off" position until it has traveled past one-half the way up or in the return direction. The separation of one-fourth the travel between the "on" position and the "off" position prevents a situation in which tiny oscillations can cause the switch to chatter or oscillate between the "on" and "off" positions with tiny movements. A membrane switch typically turns on and off as contact is made or broken between two membranes, one of which is being deformed in the switch operation so as to contact the other. This situation provides little or no mechanical hysteresis.

The most common method used to improve the tactile operation of membrane switches is to combine such switches with separate hard key caps and plungers. Additionally, such key caps and plungers are generally provided with a method of producing tactile feedback. An important and common example of this approach is used in membrane based computer keyboard. Frequently, in such keyboard applications, a separate key cap and plunger are supported above the membrane switch by a silicon collar. The silicon collar is designed to collapse non-linearly as pressure is applied to it. Specifically, as the collar is depressed, its resistance to motion increases up to a point where the collar collapses in a buckling manner. When this occurs, the resistance to motion through the collar decreases. This increase and subsequent reduction of force frequently is referred to as tactile breakaway. The disadvantages of this system are increased complexity of the overall keyboard switch device, increased size (particularly with respect to the depth parallel to the direction of travel), and the fact that the silicon collars weaken and change resistance with heavy usage, over time.

An approach to improving tactile feedback of a membrane switch is disclosed in the United States patent to Goll, U.S. Pat. No. 3,681,723. This patent employs magnets to repel a pair of membrane sheets from one another; so that a pre-established force must be overcome in order to close the switch. All of the other disadvantages of conventional membrane switches, however, are present with this switch, since the magnets do nothing more than hold the sheets apart, essentially aiding in the resilient tendency of the sheets to hold the switch contacts open.

A different approach is disclosed in the U.S. patent to Michalski U.S. Pat. No. 4,349,712. This patent provides a tactile feedback through the use of a "dome" in the membrane material. This dome provides a "snap-over" or "snap" action operation. The membrane of the switch in Michalski is not a flat membrane; and the materials employed must be more rigid or spring-like than the membranes which are used in many other membrane switches. The switch of Michalski, however, does provide an indication when the switch moves from its open position to its closed position; although this is a single "snap-over" type of operation. Because of the nature of the switch, however, chattering also inherently is reduced.

It is desirable to provide an improved membrane switch having reduced chattering and enhanced tactile feedback, which is simple, easy to manufacture, of relatively low cost, and which can be used in conjunction with standard membrane switch materials.

SUMMARY OF THE INVENTION

It is an object of this invention to provide an improved membrane switch.

It is an additional object of this invention to provide improved tactile feedback in a membrane switch.

It is another object of this invention to provide an improved membrane switch having reduced chatter.

It is a further object of this invention to provide an improved membrane switch having improved tactile feedback and reduced chatter.

In accordance with a preferred embodiment of the invention, a magnetically enhanced membrane switch operator is provided. A rigid base plate with ferromagnetic material on at least a portion of it forms a support for the remainder of the switch. A rigid cover plate has an opening through it and has ferromagnetic material on at least a portion surrounding the opening. The rigid base plate and rigid cover plates are supported in a spaced relationship with one another, with the ferromagnetic portions on the base plate and the cover plate located opposite one another. A flexible membrane sheet of dielectric material then is suspended between the rigid cover plate and the rigid base plate. This membrane sheet has a magnetized portion on it located between the ferromagnetic portions of the rigid base plate and the rigid cover plate. In its relaxed or unoperated mode, the magnetized portion on the membrane sheet is attracted to the cover plate to urge the membrane sheet toward engagement with the cover plate. When the switch is operated, this magnetic attraction is broken; and the magnetized portion of the flexible membrane sheet aids in attracting the membrane sheet to the base plate as the membrane is pressed toward the base plate through the hole in the cover plate.

DETAILED DESCRIPTION

Figures 1, 2, 3:
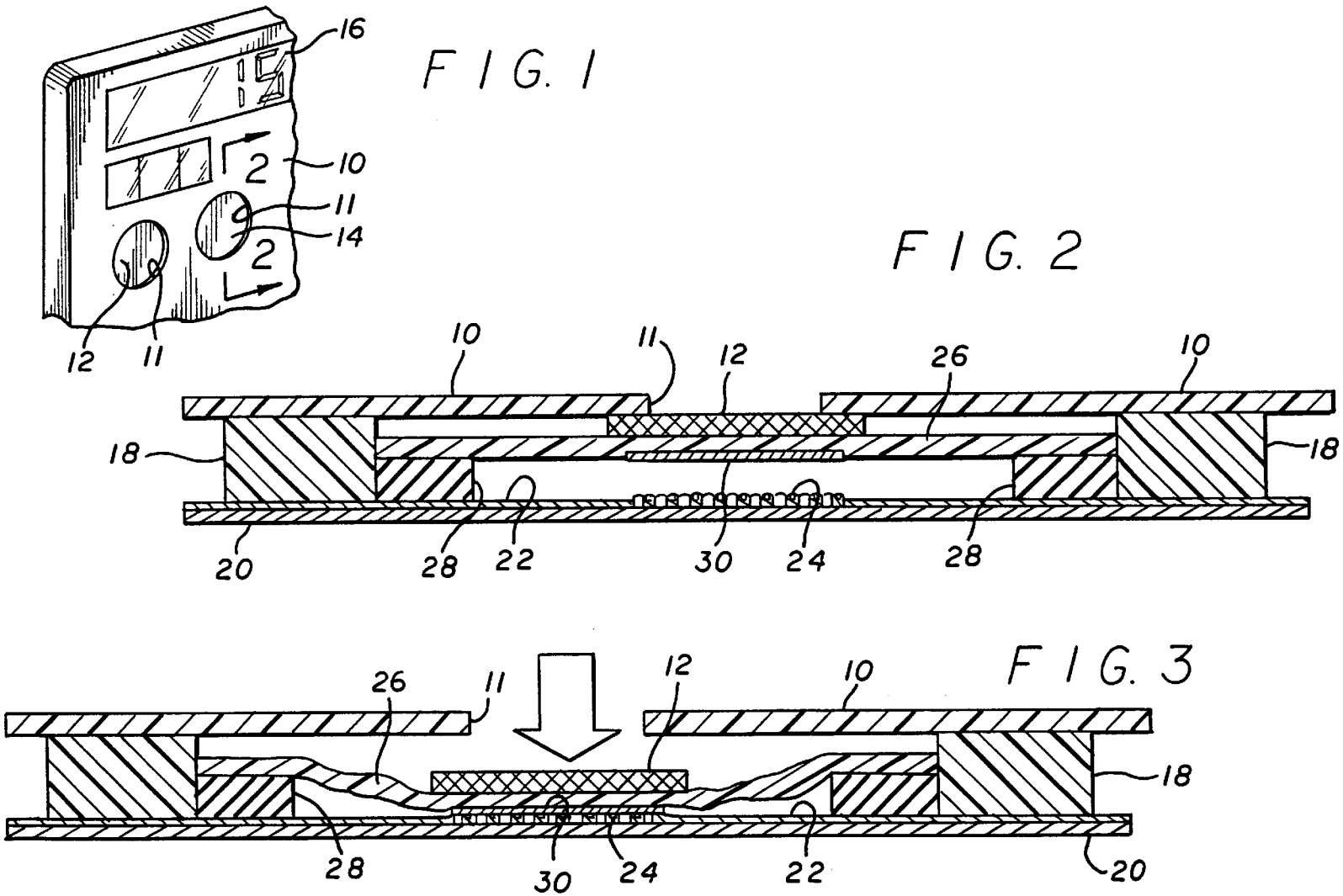
FIG. 1 a diagrammatic partial perspective view of one environment in which the preferred embodiment of the invention may be used.
FIG. 2 is a cross-sectional view of a preferred embodiment of the invention showing a first position of operation.
FIG. 3 is a cross-sectional view of the preferred embodiment of the invention showing a second position of operation.

Reference now should be made to the drawing, in which the same reference numbers are used throughout the different figures to designate the same or similar components. FIG. 1 illustrates the corner of an electronic device, such as a hand-held calculator or the like. The device shown in FIG. 1 has a cover plate 10 with a plurality of circular apertures 11 (two of which are shown in FIG. 1) located in it for swift input operation. Two such switches 12 and 14 are illustrated in FIG. 1. The device which is shown in part in FIG. 1 also includes a display 16 of the type typically associated with such hand-held calculators. It should be noted that the device shown in FIG. 1 could as well be a computer keyboard or other device having cover plate 10 with spaced circular (or other shapes) openings 11 in it for operation of a membrane switch 12 or 14.

FIG. 2 is a cross section taken along the line 2—2 of FIG. 1 to show the internal structure of the magnetically enhanced membrane switch of a preferred embodiment of the invention which may be used in conjunction with the calculator or other device, such as shown in FIG. 1. The cover plate 10 with a circular opening 11 in it is illustrated. The switch also includes a base plate 20; and in the embodiment shown in FIG. 2, both the cover plate 10 and the base plate 20 are rigid plates made of ferromagnetic material. In the alternative, the base plate 20 and the cover plate 10 may be made of any suitable rigid material, provided that there is a ferromagnetic portion located in the cover plate 10 around the opening 11 and in the base plate 20 immediately below (as shown in FIG. 2) the central portion of the circular opening 11. In the preferred embodiment, however, both the plates 10 and 20 are constructed uniformly throughout of ferromagnetic material.

The plates 10 and 20 are held apart a predetermined distance by a spacer 18, which may be made of any suitable material, typically a non-metallic plastic. In the area in the space provided by the spacers 18, a resilient flexible membrane sheet 26 of the type typically used with membrane switches is stretched and suspended on supports 28, as illustrated. In the relaxed state of the resilient membrane 26, it is stretched across the space beneath the opening 11, as indicated in FIG. 2. The membrane 26 has a permanent magnet disk 12 secured to the upper surface beneath the opening 11; so that the disk 12 is magnetically attracted to and engages the ferromagnetic plate 10 around the circular opening 11 to hold the membrane 26 in the open or non-operated position of the switch, as illustrated in FIG. 2.

The upper surface of the base ferromagnetic plate 20 has a dielectric circuit board or second membrane 22 on it with a conductive pattern 24 located in the area beneath the circular opening 11, again as illustrated in FIG. 2. The lower surface of the resilient deformable membrane sheet 26 has a conductive flexible disk attached to it for effecting electrical contact across the conductors 24 on the sheet 22 whenever operation of the switch to close various contacts is made. Typically, the disk is made of a silicon rubber mixture containing carbon; so that it is both flexible and electrically conductive. Such conductive disks are commonly used in conventional membrane switches.

As mentioned above, in the normal or non-operated position of the switch as illustrated in FIG. 2, the membrane sheet 26 is held adjacent the cover plate 10 both by the magnetic attraction between the magnet 12 and the cover plate 10 and the rest or normal position of the resilient membrane 26 to which the magnet 12 is attached. When an operator applies downward pressure in the direction of the arrow shown in FIG. 3 to the magnetic disk 12, resistance to motion is provided by both the resilience of the membrane 26 and the magnetic attraction between the disk 12 and the cover plate 10. As the finger pressure exerted by the operator increases, the disk 12 begins to separate from the cover plate 10; and the operator feels a decreased resistance to further movement as the disk 12 separates from the cover plate 10. This decreased resistance is felt as a tactile breakaway sensation or switch "tease".

As continuing downward pressure moves the disk 12 and stretches the membrane 26 to deform it as shown diagrammatically in FIG. 3, the disk 12 moves close enough to the ferromagnetic base plate 20 to be magnetically attracted to the base 20. This then assists in snapping closed or operated the membrane switch into the position shown in FIG. 3. When this occurs, further travel is prevented; and a distinctive tactile feel to the finger of the person operating the switch is generated. The magnetic attraction of the magnetic disk 12 to the ferromagnetic base 20 also ensures that reliable closure or activation of the switch is achieved. This further tends to reduce the tendency of the switch to chatter.

The resiliency or strength of the membrane sheet 26, to which the magnetic disk 12 is attached, is chosen to be sufficient to cause the membrane sheet 26 to return to the rest or unoperated position shown in FIG. 2 by overcoming the attraction between the magnetic disk 12 and the ferromagnetic base plate 20 when external force ceases to be applied to the disk 12 through the hole or opening 11. If an operator desires to hold the switch in the closed position shown in FIG. 3, it takes less force to do this than if the magnetic attraction between the magnetic disk 12 and the ferromagnetic plate 20 were not present. In addition, if the disk 12 starts to separate farther from the base plate 20, the person operating the switch will feel a tactile increase in the upward pressure as a tactile indication that the switch is beginning to open or has opened. Consequently, the tactile feedback needed to ensure accurate efficient operation of the switch is provided to the operator.

From the foregoing it is apparent that the switch which has been described above in conjunction with the preferred embodiment shown in FIGS. 1 through 3 offers a number of improvements over existing membrane switch technology. The switch described provides tactile user feedback, both at the onset of switch operation or travel and at completion of travel. It further reduces mechanical switch chatter; and the magnetic forces remain consistent over time and do not decrease with usage.

Although the foregoing description of the preferred embodiment of the invention describes the cover plate 10 and the base plate 20 as being made of ferromagnetic material, and with the circular plate 12 being a permanent magnet, reversal of these parts could be effected. Thus, the circular plate 12 may be made of ferromagnetic material and permanent magnets may be provided, either in whole or in part for the cover plate 10 and the base plate 20. This reversal of parts is certainly contemplated and is considered equivalent to the specific structure which has been shown and described above.

The foregoing description of the preferred embodiment of the invention is to be considered as illustrative and not as limiting. Various changes and modifications will occur to those skilled in the art for performing substantially the same function, in substantially the same way, to achieve substantially the same result without departing from the true scope of the invention as defined in the appended claims.

What is claimed is:

1. A magnetically enhanced membrane switch operator including in combination:

a rigid base plate having ferromagnetic material on at least a portion thereof;

a cover plate having an opening therethrough and having ferromagnetic material on at least a portion thereof surrounding the opening therein;

a support between said rigid base plate and said cover plate holding said plates a predetermined distance apart, with the ferromagnetic portions on said rigid base plate and said cover plate located opposite one another; and a flexible membrane sheet of dielectric material suspended between said cover plate and said rigid base plate and having a magnetized portion thereon located between the ferromagnetic portions of said rigid base plate and said cover plate.

2. The combination according to claim 1 wherein said cover plate is a rigid cover plate.

3. The combination according to claim 2 wherein said flexible membrane sheet is normally located so that the magnetized portion thereon attracts it to engage said cover plate whereupon force is required to overcome the magnetic attraction between the magnetized portion on said flexible membrane and said cover plate.

4. The combination according to claim 3 wherein said flexible membrane sheet is a resilient sheet requiring a predetermined amount of force to distort said sheet and overcome the magnetic attraction between the magnetized portion thereon and said cover plate, whereupon movement of said sheet a predetermined distance away from said cover plate causes the magnetized portion of said membrane sheet to be attracted to said rigid base plate facilitating further downward movement of said flexible membrane sheet toward said rigid base plate.

5. The combination according to claim 4 wherein the magnetic attraction between said flexible membrane sheet and said rigid base plate is less than a resilient elasticity force of said flexible membrane sheet.

6. The combination according to claim 5 wherein said flexible membrane is a resilient membrane normally biased away from said rigid base plate toward said rigid cover plate.

7. The combination according to claim 6 further including conductive switch patterns formed on facing surfaces of said flexible membrane sheet and said rigid base plate, whereupon exertion of force through said opening in said rigid cover plate on said flexible membrane sheet in excess of a predetermined amount causes contact closure of said conductive switch patterns.

8. The combination according to claim 7 wherein said conductive switch pattern on said flexible membrane sheet comprises a flexible conductive disk.

9. The combination according to claim 8 wherein said flexible conductive disk is made of a silicon rubber mixture containing carbon.

10. The combination according to claim 1 wherein said flexible membrane is a resilient membrane normally biased away from said rigid base plate toward said rigid cover plate.

11. The combination according to claim 10 wherein said flexible membrane sheet is normally located so that the magnetized portion thereon attracts it to engage said cover plate whereupon force is required to overcome the magnetic attraction between the magnetized portion on said flexible membrane and said cover plate.

12. The combination according to claim 11 wherein said flexible membrane sheet is a resilient sheet requiring a predetermined amount of force to distort said sheet and overcome the magnetic attraction between the magnetized portion thereon and said cover plate, whereupon movement of said sheet a predetermined distance away from said cover plate causes the magnetized portion of said membrane sheet to be attracted to said rigid base plate facilitating further downward movement of said flexible membrane sheet toward said rigid base plate.

13. The combination according to claim 12 wherein the magnetic attraction between said flexible membrane sheet and said rigid base plate is less than the resilient elasticity force of said flexible membrane sheet.

14. The combination according to claim 1 further including conductive switch patterns formed on facing surfaces of said flexible membrane sheet and said rigid base plate, whereupon exertion of force through said opening in said rigid cover plate on said flexible membrane sheet in excess of a predetermined amount causes contact closure of said conductive switch patterns.

15. The combination according to claim 14 wherein said conductive switch pattern on said flexible membrane sheet comprises a flexible conductive disk.

16. The combination according to claim 15 wherein said flexible conductive disk is made of a silicon rubber mixture containing carbon.

17. The combination according to claim 1 wherein said flexible membrane sheet is a resilient sheet requiring a predetermined amount of force to distort said sheet and overcome the magnetic attraction between the magnetized portion thereon and said cover plate, whereupon movement of said sheet a predetermined distance away from said cover plate causes the magnetized portion of said membrane sheet to be attracted to said rigid base plate facilitating further downward movement of said flexible membrane sheet toward said rigid base plate.

18. The combination according to claim 17 wherein the magnetic attraction between said flexible membrane sheet and said rigid base plate is less than a resilient elasticity force of said flexible membrane sheet.

19. The combination according to claim 1 wherein said flexible membrane sheet is normally located so that the magnetized portion thereon attracts it to engage said cover plate whereupon force is required to overcome the magnetic attraction between the magnetized portion on said flexible membrane and said cover plate.

20. A magnetically enhanced membrane switch operator including in combination:

a rigid base plate having either ferromagnetic material or a magnet on at least a portion thereof;

a cover plate having an opening therethrough and having either ferromagnetic material or a magnet on at least a portion thereof surrounding the opening therein;

a support between said rigid base plate and said cover plate holding said plates a predetermined distance apart, with the ferromagnetic portions or magnets on said rigid base plate and said cover plate located opposite one another; and a flexible membrane sheet of dielectric material suspended between said cover plate and said rigid base plate and having either a ferromagnetic portion or a magnetized portion thereon located between said rigid base plate and said cover plate.

21. The combination according to claim 20 wherein said cover plate is a rigid cover plate.

22. The combination according to claim 20 wherein said flexible membrane is a resilient membrane normally biased away from said rigid base plate toward said rigid cover plate.

23. The combination according to claim 20 further including conductive switch patterns formed on facing surfaces of said flexible membrane sheet and said rigid base plate, whereupon exertion of force through said opening in said rigid cover plate on said flexible membrane sheet in excess of a predetermined amount causes contact closure of said conductive switch patterns.

* * * * *